US006189854B1

(12) United States Patent
Irurzun Saez De Maturana

(10) Patent No.: US 6,189,854 B1
(45) Date of Patent: Feb. 20, 2001

(54) PERFECTED HORIZONTAL FORMWORK

(75) Inventor: Miguel Angel Irurzun Saez De Maturana, Oñate (ES)

(73) Assignee: Ulma CYE, S. Coop, Onate Guipuzcoa (ES)

( * ) Notice: Under 35 U.S.C. 154(b), the term of this patent shall be extended for 0 days.

(21) Appl. No.: 09/150,713

(22) Filed: Sep. 10, 1998

(30) Foreign Application Priority Data

Sep. 15, 1997 (ES) ..... 9701932

(51) Int. Cl.[7] ..... E04G 11/38; E04G 11/56

(52) U.S. Cl. ..... 249/18; 52/376; 52/720.1; 52/729.4; 249/210

(58) Field of Search ..... 52/126.5, 126.6, 52/365, 376, 720.1, 729.5, 731.2, 732.1, 733.3; 249/18, 28, 210; 182/186.3, 186.4, 186.5, 186.6, 186.7, 186.8, 186.9; 428/595, 599, 603, 598

(56) References Cited

U.S. PATENT DOCUMENTS 1,350,544 * 8/1920 Brown ..... 52/720.1
1,523,106 * 1/1925 Dornier ..... 52/731.2
3,322,448 * 5/1967 Rolland ..... 52/731.2
3,332,179 * 7/1967 Toti ..... 52/731.2
3,899,857 * 8/1975 Mochizuki ..... 52/126.6
4,144,690 * 3/1979 Avery ..... 52/731.2
4,831,797 * 5/1989 Vladikovic ..... 52/126.6
5,417,028 * 5/1995 Meyer ..... 52/720.1
5,605,239 * 2/1997 De Voursney et al. ..... 428/595

* cited by examiner

*Primary Examiner*—Michael Safavi
(74) *Attorney, Agent, or Firm*—Ladas & Parry

(57) ABSTRACT

A formwork is structured of a lower substrate of beams that are supported on struts, and a substrate with identical beams supported on and perpendicular to the lower beams. Resting upon the upper beams, there are panels of wood that make up the surface of the formwork; the beams are formed from steel plate of great strength and small wall thickness. The beams (1) have a trapezoidal configuration with an upper projection forming a channel that holds wooden strips. The beams have lateral folds or lateral ridges for rigidity. The beams of the lower substrate rest upon bidirectional heads (4) having wings (16) and a lower cylindrical portion (14) that connects onto the upper end of a corresponding strut.

20 Claims, 5 Drawing Sheets

PERFECTED HORIZONTAL FORMWORK

OBJECT OF THE INVENTION

The present invention refers to horizontal formwork, of the type used for obtaining wrought iron, in which there must be a perfectly plane surface for laying the mass of concrete. The formwork is structured on the basis of a series of parallel beams forming two substrates, one lower and the other upper, arranged transversely to each other, the lower beams being supported on struts.

The object of the invention is to provide a formwork structure by means of which maximum rigidity or structural strength is achieved with minimum weight, so as to allow easy handling of the beams that form part of the formwork. It is also an object of the invention to provide a simple structure, based on simplicity and a minimum number of parts that make it up.

BACKGROUND OF THE INVENTION

The Spanish invention patent with application number 9602019, of the same applicant, describes a horizontal formwork made up, as is conventional, of a lower substrate of beams supported on struts and an upper substrate of beams perpendicular to the foregoing, complemented finally by upper panels that constitute the formwork surface.

On the basis of these characteristics, in the said invention patent, in order to achieve high flexion strength in the beams, the latter are made of metallic plate and with a special design that gives rise to a reduction of weight in comparison to conventional beams.

Specifically, the said invention patent claims the fact that the beams of the lower substrate are made from a thin steel plate and form in their upper part the classic channelling for holding the also classic wooden strip, while in their lower part they have connection cylinders, both in their end areas and at the intermediate points where they are to be supported on struts. In the latter case they are to be coupled by means of tongue and groove inside the said struts, and at the ends they are to be coupled to intermediate joining parts which, with a general "U" shape, are able to receive in their interior the ends of two adjoining beams, having for this purpose lateral is holes for coupling the connection cylinders of the said beams, while in the middle they have another connection cylinder, projecting downwards, for coupling the corresponding strut.

For their part, the beams of the upper substrate are made up of a structure relatively similar to that of the beams of the lower substrate, but without connection cylinders. The beams of the upper substrate have a great profusion of orifices in their side walls, which give rise to a substantial lightening of material; some of these orifices, rectangular in shape, are obtained by stamping out and pressing, defining wings that project perpendicularly towards the inside of the beam, which make the structure of the same considerably more rigid.

In spite of the fact that the horizontal formwork obtained in accordance with what is described and claimed in the said Spanish invention patent No. 9602019, effectively fulfills the objectives for which it was conceived, nevertheless when the beams are subjected to very great stresses they may undergo warping, which may cause them to open.

SUMMARY OF THE INVENTION

The formwork of the invention, based on the type of formwork described in the foregoing section, has structural characteristics in respect of the beams and the means of support on the struts that allow a system to be obtained that has a great capacity for withstanding stresses. Moreover, the beams lack the connection parts of the previous version, because support of the beams of the upper substrate is effected directly upon the beams of the lower substrate, and these in turn on bidirectional heads attached to the struts themselves.

More specifically, the type of beam used in the formwork of the invention has in its upper part the corresponding channelling for holding the wooden strip that will allow the beams of the upper substrate to be fixed, with the peculiarity that the body of this beam is made up of a trapezoidal profile section which, in a preferred embodiment of the invention, has a fold in its upper part that coincides with the base of the channelling, giving the beam great strength. In a variant of the embodiment, the beam lacks this upper reinforcement fold, but in its place it has a series of vertical ridges of great size that correspond with the sides of the beam's body, and also ridges of smaller width arranged longitudinally in the channelling that receives the wooden strips.

In any case, the beam is finished at both ends with covers made of metal plates welded to the perimeter of the beam, which have a dual function:

1.— To prevent foreign material, cement and other aterial, from entering the beam, which would unnecessarily ncrease its weight.

2.— To provide the beam unit with greater rigidity.

It should be noted that in the central area of its supporting base the beam has a slight hollow or curvature to ensure that it supports through its ends and consequently has a good seating.

As regards the fixing of the wooden strip in the corresponding upper channelling of the beam, this is conveniently effected by means of nails or screws that laterally pierce the corresponding channelling.

As is clear, and has been said hereinbefore, the beams of the upper substrate are supported directly upon the beams of the lower substrate, while the latter are supported upon the struts through bidirectional heads that have a single cylindrical connector projecting downwards and which fits inside the upper end of the struts. This cylindrical connector may even have an external screw thread for better fixing inside the struts.

The bidirectional heads, made from a quadrangular plate, with the cylindrical connector emerging from the center of its lower side, have pairs of wings projecting vertically upwards on two opposite sides. These wings are arranged at the ends of the said sides and are provided so as to prevent the movement of the beams, which must support exactly upon the bidirectional heads.

The separation between the wings on both sides of the head is such that it allows two contiguous beams to be upported, and these overlap each other to make a zig-zag arrangement, in such a way that the wings are oriented lengthwise to the direction of the beams and the latter are immobilized laterally by the said wings of the bidirectional head. However, if the head is situated with a 90° shift from the position mentioned hereinbefore, then it constitutes an intermediate support for the beam, in which case the beam remains between the inner edges of the wings of the head, these inner edges being those that immobilize the beam to prevent its lateral movement.

Although throughout the present description it has been indicated that the beams are intended to be supported upon struts, the interposition of the bidirectional heads referred to hereinbefore means that they may also be used when they are supported on a scaffold, and may even be used in projections, which are generally shaped by means of a tubular structure called a "French hand".

BRIEF DESCRIPTION OF THE DRAWINGS

To complement the description that is being given and in order to aid understanding of the invention's characteristics, in accordance with a preferred practical embodiment of the same, a set of drawings accompanies the said description as an integral part of it in which, in an illustrative and non-restrictive way, the following is represented.

DETAILED DESCRIPTION OF PREFERRED EMBODIMENT

Figure 1:
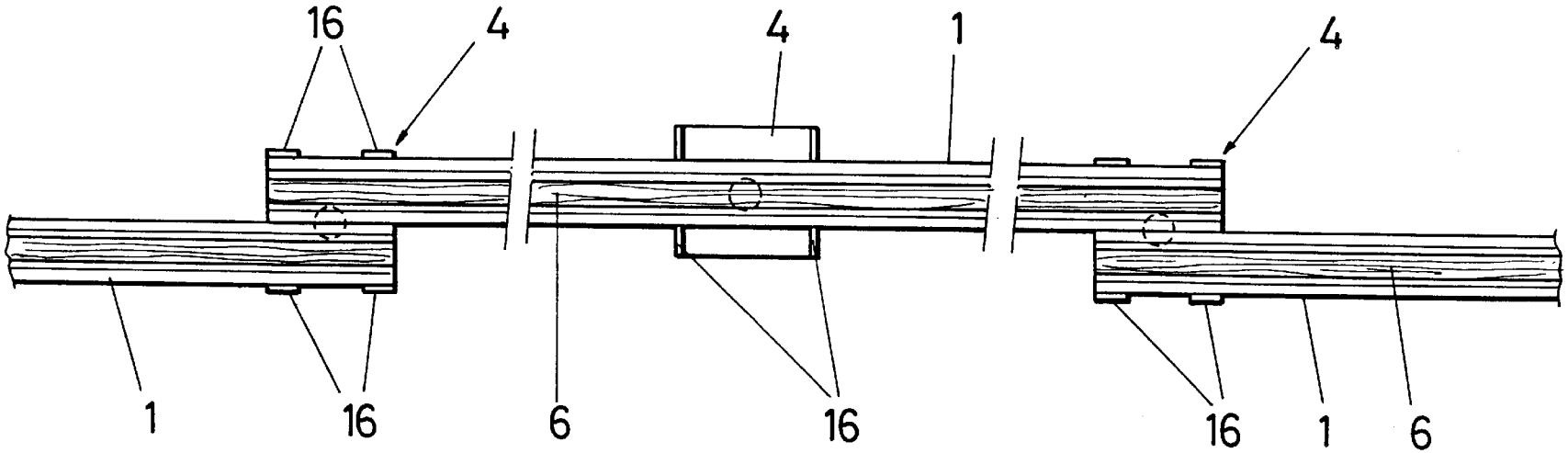
FIG. 1. Shows a diagrammatic representation of a top view of an alignment of three beams corresponding to the lower substrate of a horizontal formwork carried out in accordance with the object of the present invention. It may be observed that the intermediate beam is supported upon the corresponding bidirectional head shifted 90° with espect to the heads on both sides of the beam and where the ends of two contiguous beams are supported simultaneously.
Figure 5:
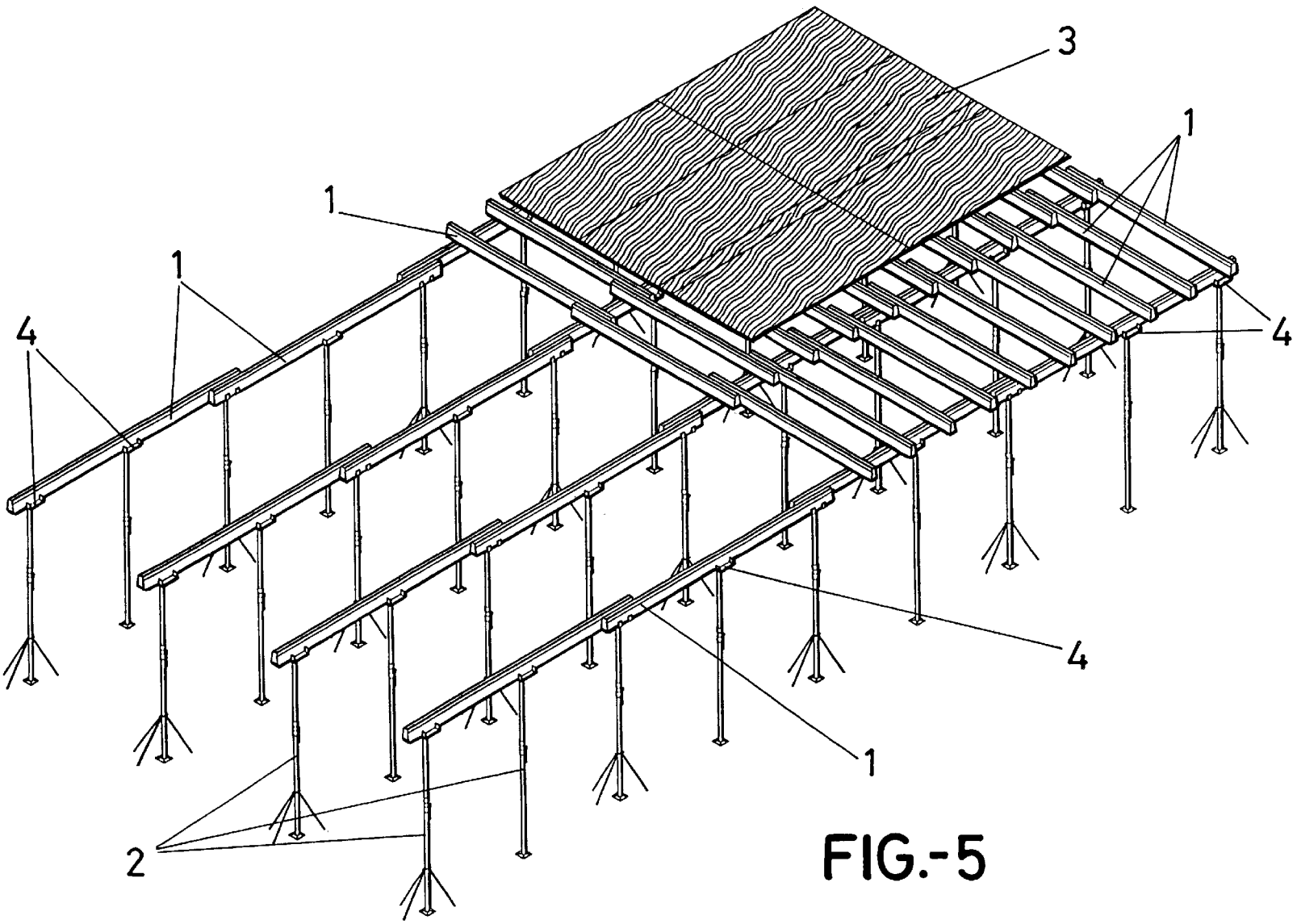
FIG. 5. Shows a diagrammatic representation in perspective of a structure with part of the framework including only the struts and beams of the lower substrate; another part of the framework including the struts, the beams of the lower substrate and the beams of the upper substrate, and another part of the framework with everything described previously and with the wooden panels that form the surface of the formwork proper.

From these figures and more specifically from FIGS. 1 and 5, it may be observed that the proposed horizontal formwork, like any conventional formwork of this type, is made up of a number of beams (1), which form a lower substrate and which rest upon alignments of struts (2), in such a way that the said beams (1) are parallel. A second set of similar beams are placed upon the foregoing ones, perpendicular to them, forming an upper substrate upon which the wooden panels (3) are placed that constitute the surface of the formwork proper. The beams (1) of the lower substrate are supported on the struts (2) by means of bidirectional heads (4).

The beams (1) of the lower substrate and of the upper substrate are obtained from metallic plate of small thickness, made of steel or the like, whose weight is not greater than a conventional aluminum beam, but with a considerable greater flexion resistance.

Figure 2:
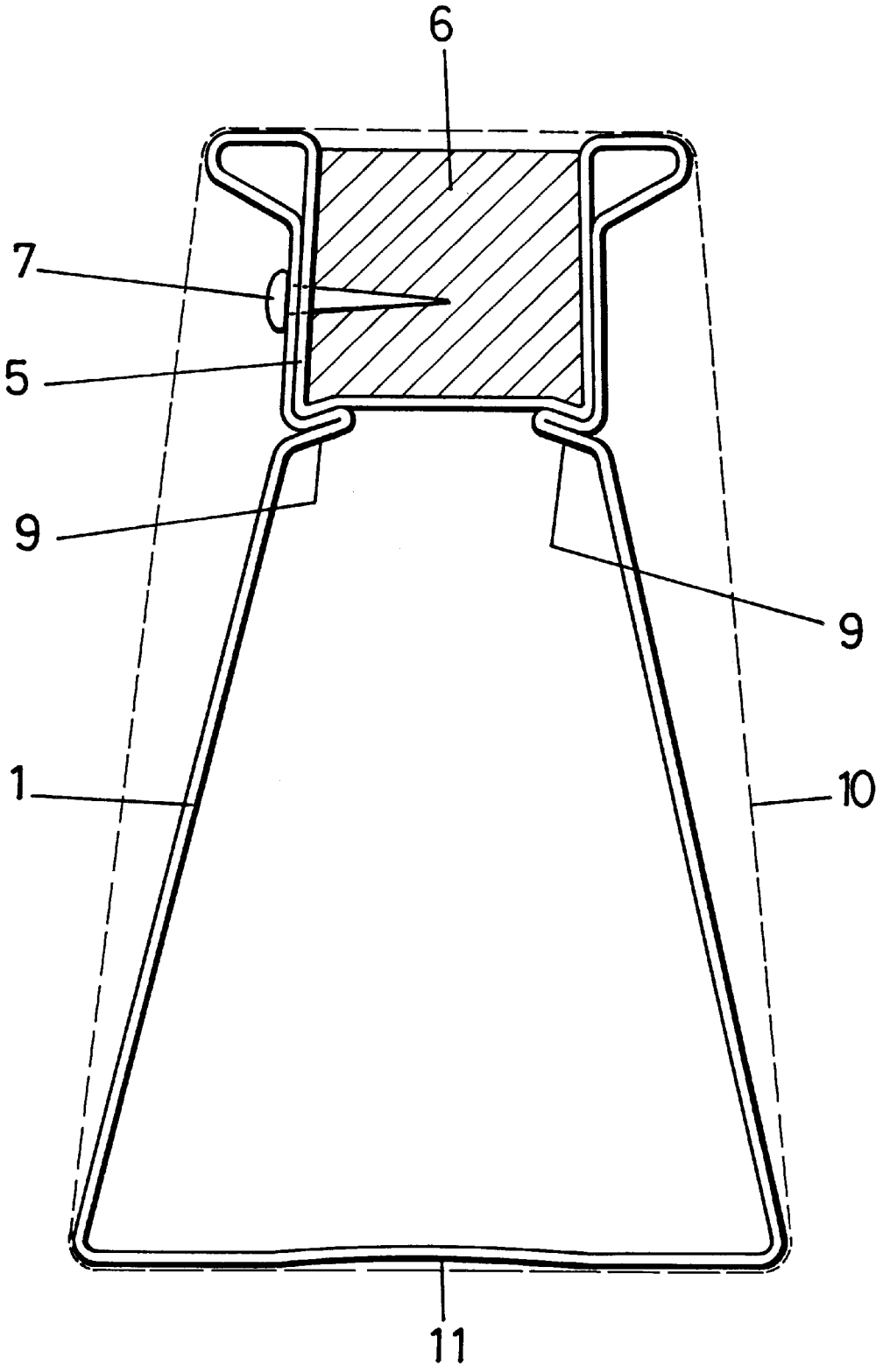
FIG. 2. Shows a cross section view of the beam carried out in accordance with the object of the invention, in which the fold may be observed that is situated under the base of the channelling or housing of the corresponding wooden strip. In this figure the corresponding plate is sketched in, which acts as a closing cover for the ends of the beam itself.

Thus, in accordance with the object of the invention, the said beams (1), both those of the lower and the upper substrates, have a trapezoidal shape as may be observed in FIG. 2, with the upper part extended in two vertical sides and with a double wall (5), forming the corresponding channelling for the wooden strip (6), which is fixed by means of transverse screws (7) that pass through the double wall (5) of the channelling proper.

Coinciding with the base (8) of the said channelling, the beam (1) includes a fold (9) corresponding with the upper part of each of the sides of the beam (1), which makes the double wall (5) act as a whole, transmitting the loads supported by the beam to the arms of the trapezium, so that the capacity of the beam to withstand stresses increases considerably.

Moreover, and as also represented in sketched lines in FIG. 2, each beam (1) is closed at its ends with plates or covers (10) welded to the perimeter of the ends of the beam (1) to prevent materials and foreign bodies from entering the beam, which would unnecessarily increase its weight; and at the same time these end plates or covers (10) give greater rigidity to the beam.

The central area of the corresponding base of the trapezoidal shape of the beam (1) has a slight hollow (11), which is curved, with horizontal surfaces on both sides through which the beam (1) carries out its corresponding support, thus ensuring a perfect stabilization in the support proper.

Figure 6:
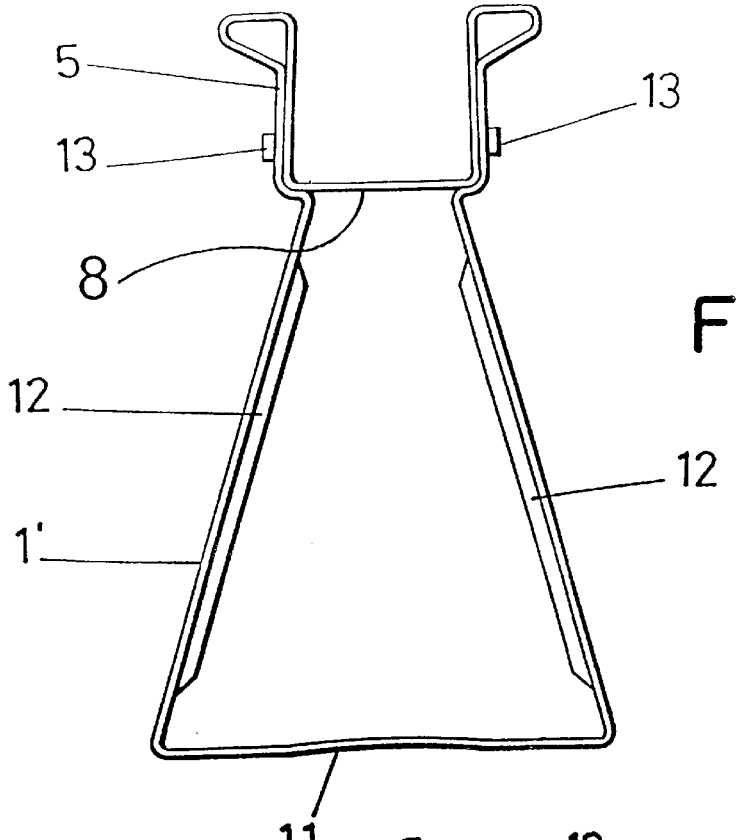
FIG. 6. Shows a section view of a variant of an embodiment of the beam that forms part of the formwork of the invention, a beam that, in this case, has ridges to give the beam the required rigidity.
Figure 7:
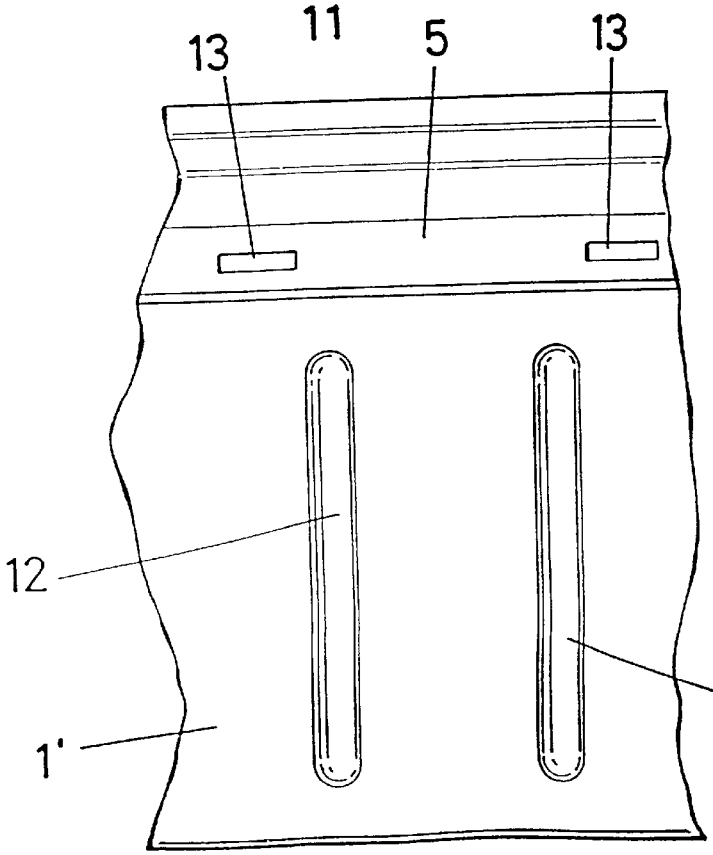
FIG. 7. Shows, finally, a detail of the arrangement and configuration of the ridges corresponding to the beam of the foregoing figure.

In a variant of the embodiment, shown in FIGS. 6 and 7, the beam (1') includes elongated ridges (12) arranged transversely in the beam's (1') sides themselves while, corresponding with the double wall (5) that forms the channelling for the wooden strip (6), other ridges (13) are included in a longitudinal direction. These ridges (12) and (13) give sufficient rigidity to the beam (1') so that it does not warp even when it receives loads that subject the beams themselves to great stresses. These ridges have the same effect as the folds (9) of the previous embodiment, that is, the double wall (5) acts as a whole and transmits the loads to the arms of the trapezoidal body of the beam (1) .

Figure 3:
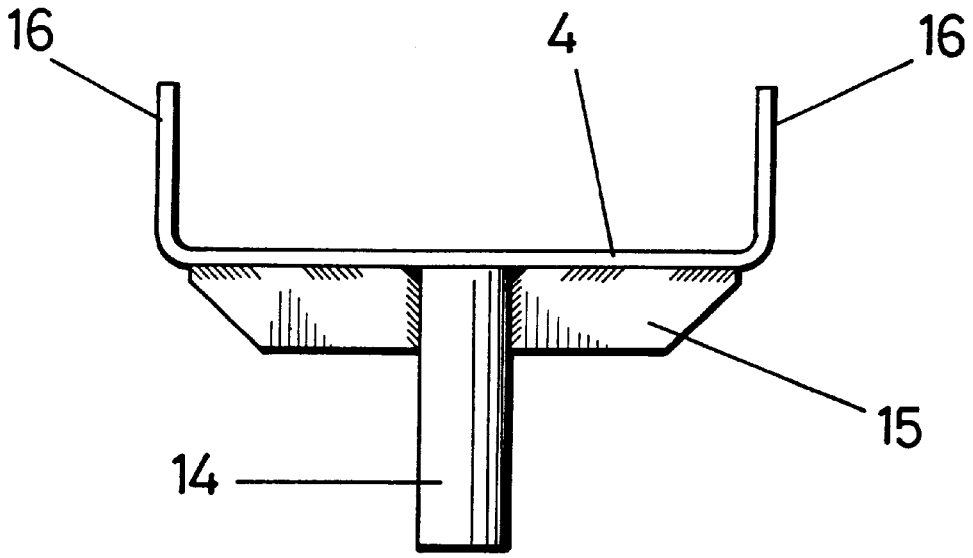
FIG. 3. Shows an elevated view of the bidirectional head used as a supporting part of the beams corresponding to the lower substrate.
Figure 4:
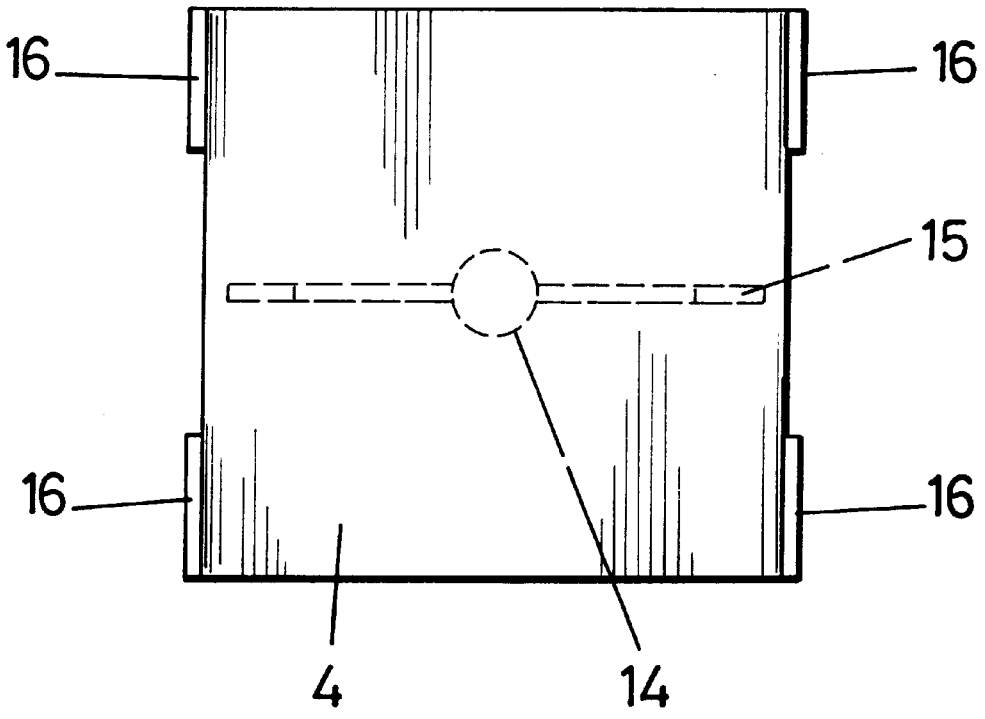
FIG. 4. Shows a top view of the bidirectional head represented in the foregoing figure.

The beams (1) of the lower substrate, in accordance with what is stated above, are supported upon the struts (2) by means of bidirectional heads (4) which, as may be observed in FIGS. 3 and 4, are made up of a quadrangular plate that corresponds to the reference itself (4), whose outer surface or lower surface has a cylindrical portion (14) constituting the part that connects to the upper end of the respective strut (2), complemented by side plates (15) in the lower part.

It is an important characteristic that these bidirectional heads (4) have pairs of wings (16) on two opposite edges at the ends, which project vertically upwards; these wings (16) immobilize the lateral movement of the beams (1) when they are supported upon the heads is (4).

More specifically, the head (4) may occupy two different working positions that are shifted 90° with respect to each other, in such a way that in the first position, with the wings arranged lengthwise to the direction of the corresponding beam (1), the heads (4) serve as a point of support in the connection areas between one beam and the next, thus receiving the two ends of the two contiguous beams (1), which are fitted in and, therefore, laterally immobilized by the wings (16) of the head, as shown in the arrangement of the two end heads of FIG. 1. In the second position of the head (4), shifted 90° with respect to the previous position, that is, with the wings arranged perpendicularly to the direction of the beam (1), as in the case of the intermediate head in FIG. 1, the heads serve as a point of support of the intermediate areas of the beams (1); the beam is thus supported upon the head and immobilized by the ends or edges of the four wings (16), which prevent the beam's lateral movement.

What is claimed is:

1. A formwork comprising:

(a) a plurality ofbeams, each of which comprises an intermediate portion and opposed end portions;

(b) a plurality of struts; and (c) a plurality of bidirectional head means for supporting the respective intermediate and end portions of the plurality of beams, each of said head means comprising;

(i) a flat bottom;

(ii) means disposed on the bottom for receiving a top end of one ofthe struts with the head means in either a first position or a second position;

(iii) a first pair of wings comprising first and second wings projecting upwardly from one side of the bottom with a space between the first and second wings, and (iv) a second pair of wings comprising third and fourth wings projecting upwardly from an opposed side of the bottom with a space between the third and fourth wings, a first of said plurality of head means being disposed on a first of the struts with the head means in the first position and supporting the intermediate portion of a first ofthe beams with the first beam disposed in the space between the first and second wings and in the space between the third and fourth wings respectively, a second of said plurality of head means being disposed on a second of the struts with the head means in the second position and supporting respective ends of the beams with the first pair of wings disposed on one side of the respective ends and the second pair of wings disposed on an opposite side of the respective ends.

2. A formwork as claimed in claim 1, wherein each ofthe beams comprises a unitary member of a plate material, said unitary member comprising a hollow bottom section of generally trapezoidal shape and a top section forming a channel for receiving a wood slat, said top section comprising a base and first and second opposed walls each of which comprises two layers of said plate material, said bottom section comprising a single layer of said plate material.

3. A formwork as claimed in claim 2, firther comprising a wood slat within the channel formed by the top section, said wood slat being fixed in the channel with a screw or nail disposed through one of the opposed walls in the top section.

4. A formwork as claimed in claim 3, wherein the at least one beam comprises cover means fixed to an end thereof for providing the at least one beam with enhanced stiffness and for preventing foreign matter from entering the at least one beam from the end.

5. A beam comprising a unitay member having a hollow bottom section of generally trapezoidal shape and a top section forming a channel for receiving a wood slat, said top section comprising a base and first and second opposed walls each of which comprises two layers of plate material, said bottom section comprising a single layer of said plate material and a base that is wider than the base of the top section, said beam further comprising means for strengthening the beam, said means for strengthening comprising first and second folds disposed beneath and at opposite ends of the base of said top section, each of said folds comprising two layers of said plate material and being inclined with respect to a middle portion of said base of the top section.

6. A beam comprising a unitary member having a hollow bottom setion of generally trapezoidal shape and a top section forming a channel for receiving wood slat, said top section comprising a base and first and second opposed walls each of which comprises two layers of plate material, said bottom section comprising a single layer of said plate material, said beam further comprising a wood slat disposed in the channel formed by said top section and means for strengthening the beam, said means for strengthening comprising a plurality of elongate ndges in the bottom section and a plurality of longitudinal ridges in the top section, said plurality of elongate ridges in the bottom section having a lentgh that is disposed transverse to a length of the beam, said plurality of longitudinal ridges in the top section having a length that is disposed along the length of the beam.

7. In a horizontal formwork comprising (a) a plurality of struts;

(b) a plurality of lower beams supported on the struts with each of the lower beams disposed substantially parallel to one another;

(c) a plurality ofupper beams supported on and disposed perpendicular to the lower beams; and (d) a surface supported on the upper beams, the improvement wherein at least one of the lower or upper beams comprises a unitary member of a plate material, said unitary member comprising a hollow bottom section of generally trapezoidal shape and a top section forming a channel for receiving a wooden slat, said top section comprising a base and first and second opposed walls each of which comprises two layers of said plate material, said bottom section comprising a single layer of said plate material.

8. A formwork as claimed in claim 7, wherein the unitary member comprises means for strengthening said at least one beam.

9. A formwork as claimed in claim 8, wherein said means for strengthening comprises a fold beneath the base of said top section, said fold comprising two layers of said plate material.

10. A formwork as claimed in claim 8, wherein said means for strengthening comprises a plurality of elongate ridges in the bottom section and a plurality of elongate ridges in the top section, said plurality of elongate ridges in the bottom section having a length that is disposed transverse to a length of the at least one beam, said plurality of elongate ridges in the top section having a length that is disposed along the length of the beam.

11. A formwork as claimed in claim 7, further comprising a plurality of bidirectional head means for supporting an intermediate portion of one of the beams with the head means in a first position and for supporting respective ends of first and second of the beams with the head means in a second position.

12. A formwork as claimed in claim 1, wherein each of the said head means comprises:

(i) a flat bottom;

(ii) socket means disposed on the bottom for receiving atop end of one of the struts with the head means in either the first position or the second position;

(iii) a first pair of wings comprising first and second wings projecting upwardly from one side of the bottom with a space between the first and second wings, and (iv) a second pair of wings comprising third and fourth wings projecting upwardly from an opposed side of the bottom with a space between the third and fourth wings, a first of said plurality of head means being disposed on a first of the struts with the head means in the first position and supporting the intermediate portion ofthe first beam with the first beam disposed in the space between the first and second wings and in the space between the third and fourth wings respectively, a second of said plurality of head means being disposed on a second of the struts with the head means in the second position and supporting respective ends of the first and second beams with the first pair of wings disposed on one side of the respective ends and the second pair of wings disposed on an opposite side ofthe respective ends.

13. A formwork as claimed in claim 7, wherein said at least one beam has an arcuate recess in a base of the bottom section.

14. A formwork as claimed in claim 12, wherein each of said socket means and each said struts comprise complementary thread means for fixing the top ends of the struts to the socket means.

15. A formwork as claimed in claim 12, further comprising a wood slat within the channel formed by the top section, said wood slat being fixed in the channel with a screw or nail disposed through one of the opposed walls in the top section.

16. A formwork as claimed in claim 12, wherein the at least one beam comprises cover means fixed to an end thereof for providing the at least one beam with enhanced stiffness and for preventing foreign matter from entering the at least one beam from the end.

17. A formwork as claimed in claim 16, wherein the plate material comprises steel.

18. A formwork as claimed in claim 7, wherein each of the plurality of lower and upper beams comprises said unitary member.

19. A beam comprising a unitary member having a hollow bottom section of generally trapezoidal shape and a top forming a channel for receiving a wood slat, said top section comprising a first and second opposed walls each of which comprises two layers of plate material, said bottom section comprising a single layer of said plate material said beam further comprising a wood slat disposed in the channel formed by said top section.

20. A beam as claimed in claim 19, further comprising means for strengthening the beam, said means for strengthening comprising a fold disposed beneath the base of said top section, said fold comprising two layers of said plate material.

* * * * *